US007434424B2

(12) United States Patent
Lueckenbach et al.

(10) Patent No.: US 7,434,424 B2
(45) Date of Patent: Oct. 14, 2008

(54) CLOTHES WASHER AGITATION TIME AND SPEED CONTROL APPARATUS

(75) Inventors: William Henry Lueckenbach, Louisville, KY (US); Christopher Gregory Hoppe, Louisville, KY (US)

(73) Assignee: General Electric Company, Schenectady, NY (US)

( * ) Notice: Subject to any disclaimer, the term of this patent is extended or adjusted under 35 U.S.C. 154(b) by 501 days.

(21) Appl. No.: 10/255,414

(22) Filed: Sep. 26, 2002

(65) Prior Publication Data

US 2004/0060123 A1 Apr. 1, 2004

(51) Int. Cl.
*D06F 33/02* (2006.01)
*D06F 13/00* (2006.01)

(52) U.S. Cl. ..... 68/12.02; 68/12.04; 68/12.12; 68/12.16; 68/133

(58) Field of Classification Search ..... 8/158, 8/159; 68/12.02, 12.04, 12.05, 12.12, 12.16, 68/12.19, 12.21, 12.27, 133, 134
See application file for complete search history.

(56) References Cited

U.S. PATENT DOCUMENTS 3,589,148 A * 6/1971 Wasemann ..... 68/12.01
4,779,431 A 10/1988 Burk et al.
5,129,241 A * 7/1992 Kiuchi et al. ..... 68/12.04
5,161,393 A * 11/1992 Payne et al. ..... 68/12.04
5,205,141 A 4/1993 Singh
5,280,660 A * 1/1994 Pellerin et al. ..... 8/158
5,291,626 A * 3/1994 Molnar et al. ..... 8/158
5,373,714 A * 12/1994 Wada ..... 68/12.02
5,560,060 A * 10/1996 Dausch et al. ..... 8/158
5,726,546 A * 3/1998 Harwood ..... 318/439
5,784,902 A 7/1998 Pinkowski et al.
5,897,672 A * 4/1999 Badami et al. ..... 8/159
6,029,298 A 2/2000 Dausch et al.
6,038,724 A * 3/2000 Chbat et al. ..... 8/159
6,415,469 B1 * 7/2002 Diaz Fernandez et al. ..... 8/158
6,418,581 B1 * 7/2002 Bruce et al. ..... 8/159
6,446,291 B1 * 9/2002 Diaz Fernandez et al. ..... 8/159

* cited by examiner

*Primary Examiner*—Joseph L Perrin
(74) *Attorney, Agent, or Firm*—George L. Rideout, Esq.; Armstrong Teasdale LLP

(57) ABSTRACT

A controller for a washing machine including an agitation element operable at a plurality of speeds during an agitation phase of a wash cycle is provided. The controller comprises a microcomputer configured to adjust an actuation of the agitation element in response to at least one input, said at least one input indicative of a characteristic of a laundry load.

5 Claims, 4 Drawing Sheets

CLOTHES WASHER AGITATION TIME AND SPEED CONTROL APPARATUS

BACKGROUND OF THE INVENTION

This invention relates generally to washing machines, and, more particularly, to methods and apparatus for controlling agitation time and agitation speed during agitation phases of wash cycles.

Washing machines typically include a cabinet that houses an outer tub for containing wash and rinse water, a perforated clothes basket within the tub, and an agitator within the basket. A drive and motor assembly is mounted underneath the stationary outer tub to rotate the clothes basket and the agitator relative to one another, and a pump assembly pumps water from the tub to a drain to execute a wash cycle. See, for example, U.S. Pat. No. 6,029,298.

Periodically as the washing machine is used, the agitator is actuated by a control mechanism and imparts an oscillatory motion to articles and liquid in the basket, thereby producing mechanical washing action and energy to clean articles in the basket. Traditionally, the agitator is actuated for a fixed time period and at a fixed, predetermined actuation speed or intensity during agitation phases of a wash cycle. For certain laundry loads, however, the agitation speed and/or the agitation duration may be excessive. Aside from energy considerations associated with unnecessary agitation, excessive agitation extends the time for the wash cycle to complete and can lead to excessive wear of laundered articles washed in the machine.

BRIEF DESCRIPTION OF THE INVENTION

In one aspect, a controller for a washing machine including an agitation element operable at a plurality of speeds during an agitation phase of a wash cycle is provided. The controller comprises a microcomputer configured to adjust an actuation of the agitation element in response to at least one input, said at least one input indicative of a characteristic of a laundry load.

In another aspect, an agitation phase control system for a washing machine is provided. The control system comprises a drive system comprising an agitation element, and a controller operatively coupled to said drive system. The controller is configured to vary operation of said agitation element in response to laundry load characteristics.

In another aspect, a washing machine is provided. The washing machine comprises a cabinet, a basket mounted within said cabinet, an agitation element mounted within said basket, and a drive system coupled to said agitation element. The drive system is configured to move said agitation element in an oscillatory manner at a plurality of speeds. A controller is operatively coupled to said drive system, and the controller comprises a microcomputer and a memory, and the memory comprises a plurality of agitation time values and a plurality of agitation speed values. The microcomputer is configured to select one of said agitation time values and one of said agitation speed values in response to laundry load inputs.

In another aspect, a method for controlling a washing machine in an agitation phase of a wash cycle is provided. The washing machine includes an agitation element therein and a controller operatively coupled thereto, and the method comprises accepting at least one laundry load input, and operating the agitation element at one of a plurality of settings based upon the laundry load input.

In still another aspect, a method for controlling a washing machine in an agitation phase of a wash cycle is provided. The washing machine includes a multi-speed drive system coupled to an agitation element and a controller operatively coupled to the drive system. The method comprises accepting a laundry soil level input, selecting one of a plurality of agitation time parameter settings in response to said soil level input, accepting a laundry load size input, selecting one of a plurality of agitation speed parameter settings in response to said load size input, and operating the drive system in accordance with the selected agitation time parameter setting and the selected agitation speed parameter setting.

DETAILED DESCRIPTION OF THE INVENTION

Figure 1:
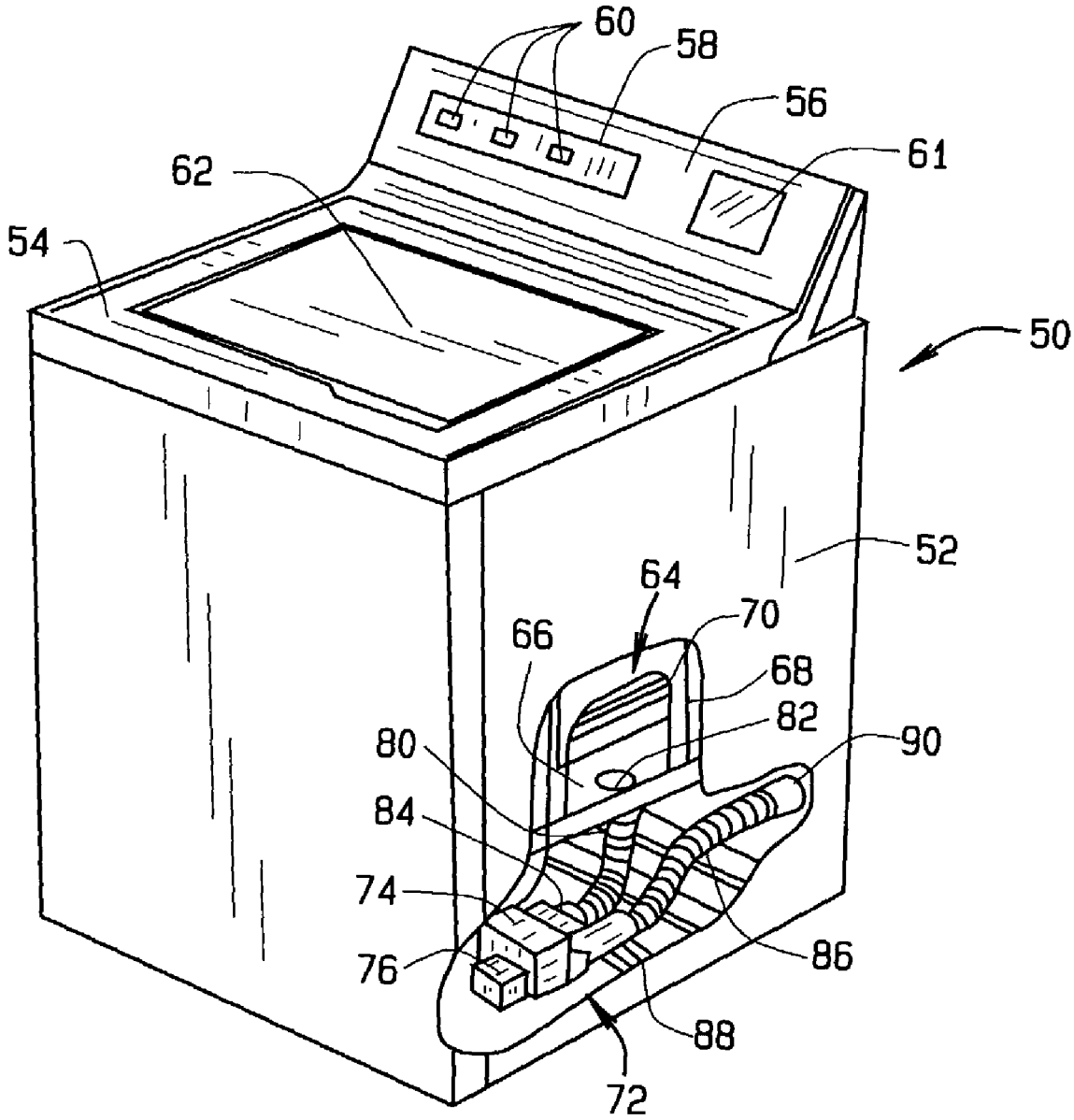
FIG. 1 is a perspective cutaway view of an exemplary washing machine.

FIG. 1 is a perspective view partially broken away of an exemplary washing machine 50 including a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment a display 61 indicates selected features, a countdown timer, and other items of interest to machine users. A lid 62 is mounted to cover 54 and is rotatable about a hinge (not shown) between an open position (not shown) facilitating access to a wash tub 64 located within cabinet 52, and a closed position (shown in FIG. 1) forming a sealed enclosure over wash tub 64. As illustrated in FIG. 1, machine 50 is a vertical axis washing machine.

Tub 64 includes a bottom wall 66 and a sidewall 68, and a basket 70 is rotatably mounted within wash tub 64. A pump assembly 72 is located beneath tub 64 and basket 70 for gravity assisted flow when draining tub 64. Pump assembly 72 includes a pump 74 and a motor 76. A pump inlet hose 80 extends from a wash tub outlet 82 in tub bottom wall 66 to a pump inlet 84, and a pump outlet hose 86 extends from a pump outlet 88 to an appliance washing machine water outlet 90 and ultimately to a building plumbing system discharge line (not shown) in flow communication with outlet 90.

Figure 2:
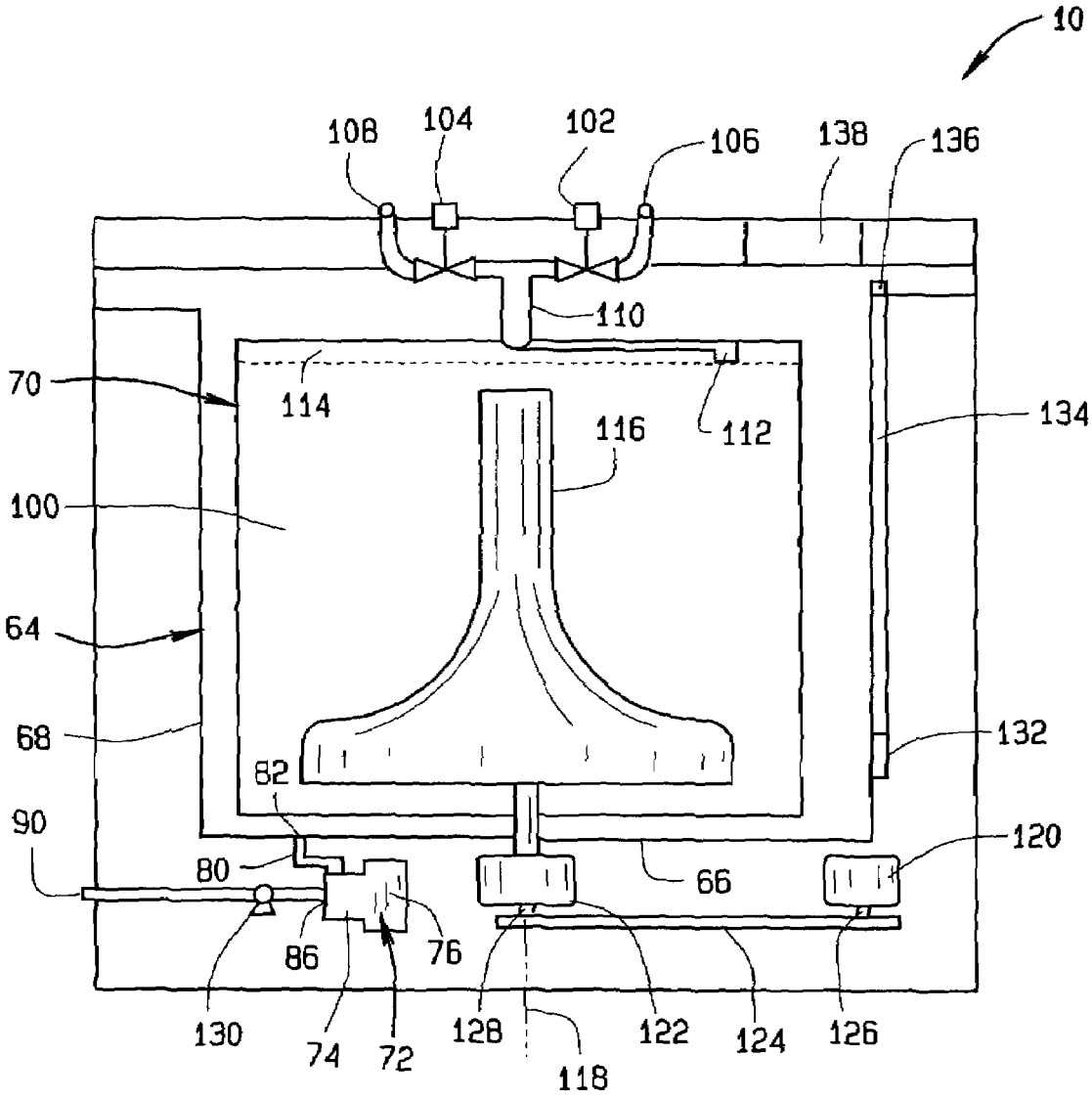
FIG. 2 is front elevational schematic view of the washing machine shown in FIG. 1.

FIG. 2 is a front elevational schematic view of washing machine 50 including wash basket 70 movably disposed and rotatably mounted in wash tub 64 in a spaced apart relationship from tub side wall 64 and tub bottom 66. Basket 12 includes a plurality of perforations therein to facilitate fluid communication between an interior of basket 70 and wash tub 64.

A hot liquid valve 102 and a cold liquid valve 104 deliver fluid, such as water, to basket 70 and wash tub 64 through a respective hot liquid hose 106 and a cold liquid hose 108. Liquid valves 102, 104 and liquid hoses 106, 108 together form a liquid supply connection for washing machine 50 and, when connected to a building plumbing system (not shown), provide a fresh water supply for use in washing machine 50. Liquid valves 102, 104 and liquid hoses 106, 108 are connected to a basket inlet tube 110, and fluid is dispersed from inlet tube 110 through a known nozzle assembly 112 having a number of openings therein to direct washing liquid into basket 70 at a given trajectory and velocity. A known dispenser (not shown in FIG. 2), may also be provided to produce a wash solution by mixing fresh water with a known detergent or other composition for cleansing of articles in basket 70.

In an alternative embodiment, a known spray fill conduit 114 (shown in phantom in FIG. 2) may be employed in lieu of nozzle assembly 112. Along the length of the spray fill conduit 114 are a plurality of openings arranged in a predetermined pattern to direct incoming streams of water in a downward tangential manner towards articles in basket 70. The openings in spray fill conduit 114 are located a predetermined distance apart from one another to produce an overlapping coverage of liquid streams into basket 70. Articles in basket 70 may therefore be uniformly wetted even when basket 70 is maintained in a stationary position.

A known agitation element 116, such as a vane agitator, impeller, auger, or oscillatory basket mechanism, or some combination thereof is disposed in basket 70 to impart an oscillatory motion to articles and liquid in basket 70. In different embodiments, agitation element 116 may be a single action element (i.e., oscillatory only), double action (oscillatory movement at one end, single direction rotation at the other end) or triple action (oscillatory movement plus single direction rotation at one end, singe direction rotation at the other end). As illustrated in FIG. 2, agitation element 116 is oriented to rotate about a vertical axis 118.

Basket 70 and agitator 116 are driven by motor 120 through a transmission and clutch system 122. A transmission belt 124 is coupled to respective pulleys of a motor output shaft 126 and a transmission input shaft 128. Thus, as motor output shaft 126 is rotated, transmission input shaft 128 is also rotated. Clutch system 122 facilitates driving engagement of basket 70 and agitation element 116 for rotatable movement within wash tub 64, and clutch system 122 facilitates relative rotation of basket 70 and agitation element 116 for selected portions of wash cycles. Motor 120, transmission and clutch system 122 and belt 124 collectively are referred herein as a machine drive system. As will be appreciated below, the motor drive system is a multiple speed drive in that it is capable of operating agitation elements at different speeds to optimize the wash cycle agitation phase.

Washing machine 50 also includes a brake assembly (not shown) selectively applied or released for respectively maintaining basket 70 in a stationary position within tub 64 or for allowing basket 70 to spin within tub 64. Pump assembly 72 is selectively activated to remove liquid from basket 70 and tub 64 through drain outlet 90 and a drain valve 130 during appropriate points in washing cycles as machine 50 is used. In an exemplary embodiment, machine 50 also includes a reservoir 132, a tube 134 and a pressure sensor 136. As fluid levels rise in wash tub 64, air is trapped in reservoir 132 creating a pressure in tube 134 that pressure sensor 136 monitors. Liquid levels, and more specifically, changes in liquid levels in wash tub 64 may therefore be sensed, for example, to indicate laundry loads and to facilitate associated control decisions. In further and alternative embodiments, load size and cycle effectiveness may be determined or evaluated using other known indicia, such as motor spin, torque, load weight, motor current, voltage or current phase shifts, etc.

Operation of machine 50 is controlled by a controller 138 which is operatively coupled to the user interface input located on washing machine backsplash 56 (shown in FIG. 1) for user manipulation to select washing machine cycles and features. In response to user manipulation of the user interface input, controller 138 operates the various components of machine 50 to execute selected machine cycles and features.

In an illustrative embodiment, clothes are loaded into basket 70, and washing operation is initiated through operator manipulation of control input selectors 60 (shown in FIG. 1). Tub 64 is filled with water and mixed with detergent to form a wash fluid, and basket 70 is agitated with agitation element 116 for cleansing of clothes in basket 70. That is, agitation element is moved back and forth in an oscillatory back and forth motion. In the illustrated embodiment, agitation element 116 is rotated clockwise a specified amount about the vertical axis of the machine, and then rotated counterclockwise by a specified amount. The clockwise/counterclockwise reciprocating motion is sometimes referred to as a stroke, and the agitation phase of the wash cycle constitutes a number of strokes in sequence. Acceleration and deceleration of agitation element 116 during the strokes imparts mechanical energy to articles in basket 70 for cleansing action. The strokes may be obtained in different embodiments with a reversing motor, a reversible clutch, or other known reciprocating mechanism.

As explained further below, and unlike convention machines utilizing a fixed stroke rate (i.e., number of strokes per unit time) and a fixed time period in the agitation phase, the present invention accommodates adjustment of the stroke rate and the agitation time period to optimize the agitation phases of wash cycles. Optimization of the agitation phases reduces wear on clothes and reduces energy consumption by the machine.

After the agitation phase of the wash cycle is completed, tub 64 is drained with pump assembly 72. Clothes are then rinsed and portions of the cycle repeated, including the agitation phase, depending on the particulars of the wash cycle selected by a user.

Figure 3:
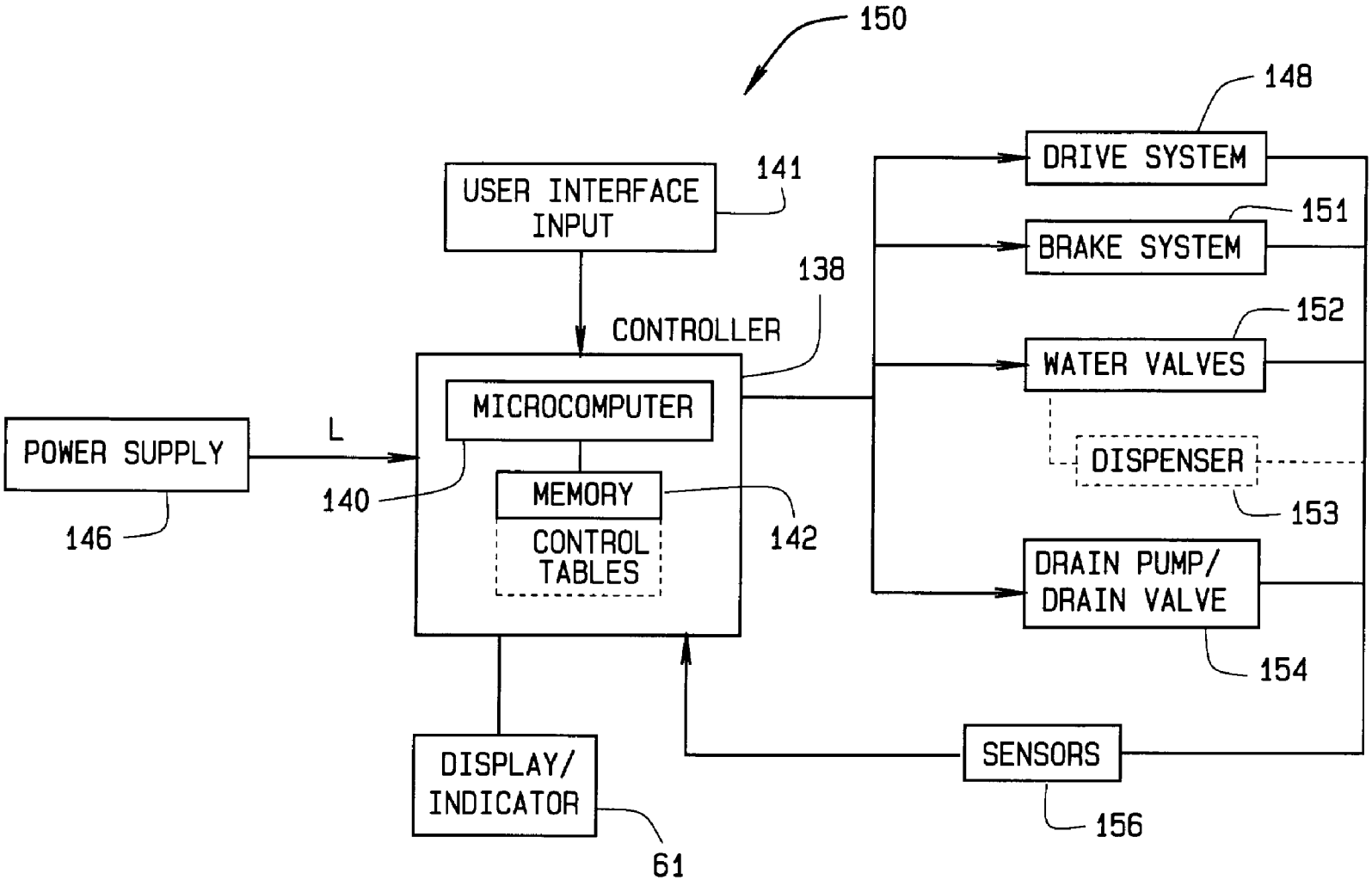
FIG. 3 is a schematic block diagram of a control system for the washing machine shown in FIGS. 1 and 2.

FIG. 3 is a schematic block diagram of an exemplary washing machine control system 150 for use with washing machine 50 (shown in FIGS. 1 and 2). Control system 150 includes controller 138 which may, for example, be a microcomputer 140 coupled to a user interface input 141. An operator may enter instructions or select desired washing machine cycles and features via user interface input 141, such as through input selectors 60 (shown in FIG. 1) and a display or indicator 61 coupled to microcomputer 140 displays appropriate messages and/or indicators, such as a timer, and other known items of interest to washing machine users. A memory 142 is also coupled to microcomputer 140 and stores instructions, calibration constants, and other information as required to satisfactorily complete a selected wash cycle. Memory 142 may, for example, be a random access memory (RAM). In alternative embodiments, other forms of memory could be used in conjunction with RAM memory, including but not limited to flash memory (FLASH), programmable read only memory (PROM), and electronically erasable programmable read only memory (EEPROM).

Power to control system 150 is supplied to controller 138 by a power supply 146 configured to be coupled to a power line L. Analog to digital and digital to analog converters (not shown) are coupled to controller 138 to implement controller inputs and executable instructions to generate controller output to washing machine components such as those described above in relation to FIGS. 1 and 2. More specifically, controller 138 is operatively coupled to machine drive system 148 (e.g., motor 120, clutch system 122, and agitation element 116 shown in FIG. 2), a brake assembly 151 associated with basket 70 (shown in FIG. 2), machine water valves 152 (e.g., valves 102, 104 shown in FIG. 2) and machine drain system 154 (e.g., drain pump assembly 72 and/or drain valve 130 shown in FIG. 2) according to known methods. In a further embodiment, water valves 152 are in flow communication with a dispenser 153 (shown in phantom in FIG. 3) so that water may be mixed with detergent or other composition of benefit to washing of garments in wash basket 70.

In response to manipulation of user interface input 141 controller 138 monitors various operational factors of washing machine 50 with one or more sensors or transducers 156, and controller 138 executes operator selected functions and features according to known methods. Of course, controller 138 may be used to control washing machine system elements and to execute functions beyond those specifically described herein.

Controller 138 operates the various components of washing machine 50 in a designated wash cycle familiar to those in the art of washing machines. However, and unlike known washing machines, controller 138 executes optimized agitation phases in wash cycles for actuation of agitation element 116 (shown in FIG. 2). Excessive agitation of clothes may therefore be minimized, thereby reducing associated wear on clothes, and energy consumption required by the agitation phase. Agitation phases of the wash cycle may be adjusted for selected or detected load sizes, types, and characteristics as further described below.

Figure 4:
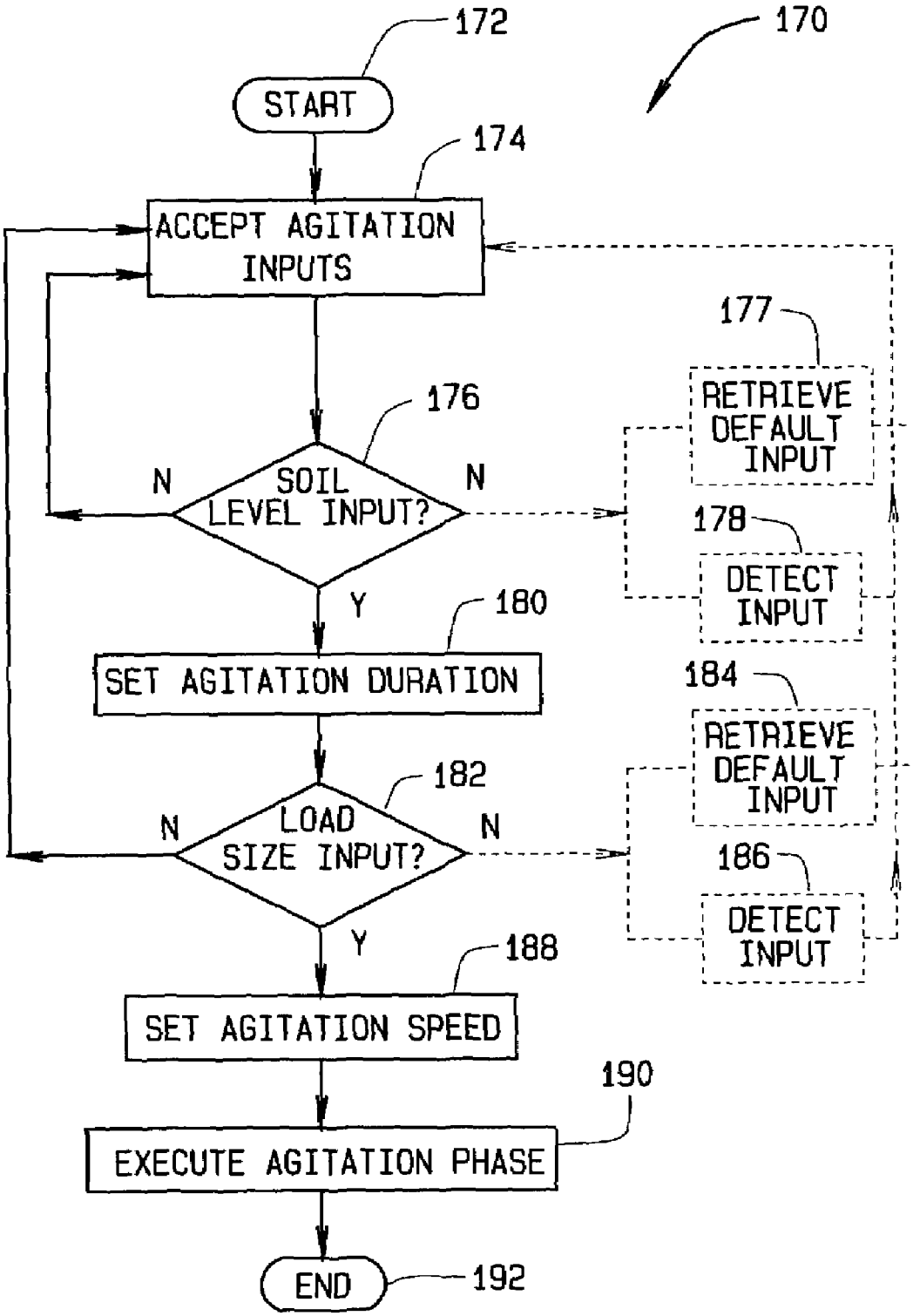
FIG. 4 is a washer agitation control algorithm executable by the controller shown in FIG. 3.

FIG. 4 is an exemplary washer agitation control method in the form of an algorithm 170 executable by controller 138 (shown in FIG. 3) for achieving optimal agitation of articles in basket 70 (shown in FIGS. 1 and 2). Algorithm 170 may be a user selected option, such as through user manipulation of one of input selectors 60 (shown in FIG. 1), or may be automatically activated or deactivated by machine controls in various embodiments.

The methodology set forth below recognizes that effectiveness of a wash cycle agitation phase is primarily dependant upon two parameters, an amount of chemical cleansing action and an amount of mechanical cleansing action. While the chemical cleansing action is partly dependent upon the soil level of articles to be washed, detergent compositions and compositions of any additives utilized in the wash cycle, the primary machine parameter that contributes to chemical cleansing action in the agitate phase is the agitate time duration. In other words, chemical cleansing action in the agitate phase of a wash cycle is a function of the agitation time. Thus, chemical cleansing action may be approximated by the relationship:

$$SR_C \propto t_{agitate} \tag{1}$$

where $SR_C$ is the chemical cleansing action and $t_{agitate}$ is the agitate time period.

The mechanical cleansing action is partly dependant upon many machine parameters, but is primarily influenced by three parameters: the agitate time period, the amount of mechanical energy introduced into the basket during agitation, and the size of the laundry load. Therefore, it may be seen that the mechanical action is approximated by the relationship:

$$SR_m \propto t_{agitate} * \frac{E_{Agitate_{Load}}}{\text{Load}} \tag{2}$$

where $SR_m$ is the mechanical cleansing action, $t_{agitate}$ is the agitation time period, $E_{Agitate_{Load}}$ is the mechanical energy input by drive system 151 (shown in FIG. 3) during the agitate phase, and Load is the size of the load to be washed. The Load may be indicated by a selected or detected load size input (e.g., small, medium, large).

Considering the mechanical energy input $E_{Agitate_{Load}}$ it may be deduced that the primary machine parameter affecting the energy input is the speed or intensity of the agitate phase of the wash cycle. In other words, the rate of oscillatory strokes (i.e., oscillatory movements per unit time) primarily determines the mechanical energy input to clothes or laundry articles. It is therefore evident that the mechanical energy input is a function of agitation speed, and that the mechanical energy input may be approximated by the relationship:

$$E_{Agitate_{Load}} \propto N_{Agitate} \tag{3}$$

where $N_{Agitate}$ is the agitation speed.

Inspection of equations (1) through (3) and substitution of Equation (3) into equation (2) reveals that:

$$SR_m \propto t_{agitate} * \frac{N_{Agitate}}{\text{Load}}. \tag{4}$$

Now comparing Equations (1) and (4), it is apparent that mechanical action and chemical action are each a function of the agitate time duration, but only mechanical actuation is a function of the agitation speed and the load size. Therefore, the agitate phase of the wash cycle can be controlled by making control decisions based upon the parameters that have the greatest overall effect on agitate cycle efficacy.

In one embodiment, controller 138 (shown in FIG. 3), through algorithm 170 makes control decisions for agitation phases of wash cycles based upon characteristics of the laundry load to be washed in machine 50 (shown in FIG. 1). Specifically, and in an exemplary embodiment, controller 138 adjusts agitation parameters based upon the laundry load size and the soil level of the laundry load. The soil level of the laundry affects the time duration of the agitation phase to optimize chemical cleansing action, and the load size affects the agitation speed or intensity of agitation element 116 (shown in FIG. 2) to optimize mechanical cleansing action.

In an exemplary embodiment, algorithm 170 begins by accepting agitation inputs 174 that affect the agitation phase of the wash cycle. Inputs may be accepted through input selectors 60 (shown in FIG. 1) and stored into controller memory 142 for later use when the agitation phase or portion of the wash cycle is commanded. In a further embodiment, controller 138, or more specifically microcomputer 140, may prompt a user for required inputs on display 61 (shown in FIGS. 1 and 3).

Once inputs are accepted 174, microcomputer 140 determines 176 whether the inputs include a SOIL LEVEL parameter. If the inputs do not include a SOIL LEVEL parameter, in one embodiment algorithm 170 returns to accept 174 additional inputs.

In a further and/or alternative embodiment controller 138 may retrieve 177 (shown in phantom in FIG. 4) a default soil level parameter from controller memory 142 if no direct soil level input is made by a machine user, or if a soil level input is not received within a predetermined time period. The default parameter may be associated with a particular wash cycle selected by the user, or may be independent of the selected wash cycle.

In another further and/or alternative embodiment, controller 138 may detect 178 (shown in phantom in FIG. 4) a soil level in the laundry load by known methods and techniques, including but not limited to the use of turbidity sensors and the like to monitor soil level of the water in the machine during use.

If a SOIL LEVEL parameter has been accepted 174, controller sets 180 agitation time or agitation duration according to the input SOIL LEVEL parameter. For example, in an illustrative embodiment, control system 150 (shown in FIG. 3) includes four SOIL LEVEL setting parameters, namely a light soil setting, a medium soil setting, a heavy soil setting, and a stain soil setting. Depending upon which of the soil level settings is selected, controller 138 sets an appropriate agitation time value corresponding to the selected setting. In general, as the accepted soil setting increases, the agitation duration increases to improve chemical cleansing action and to remove the soil, and as the accepted soil setting decreases the agitation duration decreases. Actual agitation time values may be calculated according to the above relationships or empirically determined for each of the available soil level settings. For instance, an exemplary agitation time versus soil level table for a load of cotton garments is set forth below in Table 1.

TABLE 1

| SOIL LEVEL SETTING | AGITATION DURATION |
|---|---|
| Light | 9 minutes |
| Medium | 12 minutes |
| Heavy | 15 minutes |
| Stain | 18 minutes |

A control lookup table, such as Table 1, may be stored in controller memory 142 (shown in FIG. 3) so that microcomputer 140 may select the appropriate time duration value for the selected soil level setting. Chemical cleansing action during agitation portions is therefore substantially optimized.

To improve the mechanical cleansing action of the agitation phase of a wash cycle, and further according to algorithm 170, controller 138 determines 192 whether a load size input has been accepted 174. If the inputs do not include a LOAD SIZE parameter, in one embodiment algorithm 170 returns to accept 174 additional inputs.

In a further and/or alternative embodiment controller 138 may retrieve 184 (shown in phantom in FIG. 4) a default load size parameter from controller memory 142 if no direct load size input is made by a machine user, or if a load size input is not received within a predetermined time period. The default parameter may be associated with a particular wash cycle selected by the user, or may be independent of the selected wash cycle.

In another further and/or alternative embodiment, controller 138 may detect 186 (shown in phantom in FIG. 4) a laundry load size according to known methods and techniques. Load size may be inferred from an implicit measurement of machine operation, such as operating pressure via pressure sensor 136 (shown in FIG. 2), spin torque, motor current, load weight, level sensors, voltage and/or current phase shifts, spin acceleration rates, brake stop time, or other known indicia of load size during wash operations.

If a LOAD SIZE input parameter has been accepted 174, controller sets 188 agitation speed or intensity according to the accepted LOAD SIZE parameter. For example, in an illustrative embodiment, control system 150 (shown in FIG. 3) includes five LOAD SIZE setting parameters, namely an extra small load size setting, a small load size setting, a medium load size setting, a large load size setting, and a giant load size setting. Depending upon which of the load size settings is selected, controller 138 sets an appropriate agitation speed value corresponding to the selected load size setting. As the load size setting increases, the agitation speed increases to improve mechanical cleansing action during the agitation phase, and as the load size setting decreases the agitation speed decreases. Actual agitation speed or intensity values may be calculated according to the above relationships or may be empirically determined for each of the available load size settings. For instance, an exemplary agitation speed versus load size table for a load of cotton garments is set forth below in Table 1.

TABLE 2

| LOAD SIZE SETTING | AGITATION SPEED (strokes per minute) |
|---|---|
| Extra Small | 100 |
| Small | 130 |
| Medium | 140 |
| Large | 155 |
| Giant | 155 |

A control lookup table, such as Table 2, may be stored in controller memory 142 (shown in FIG. 3) so that microcomputer 140 may select the appropriate agitation speed value for the selected load size setting. Mechanical cleansing action during agitation portions of the wash cycle is therefore substantially optimized.

While four soil level settings and five load settings are set forth above in exemplary tables 1 and 2, it is anticipated that Tables 1 and 2 may include greater or fewer than four and five settings, respectively, without departing from the scope of the present invention. Further it is contemplated that additional soil level versus agitation time and load size settings versus agitation speed tables be included in controller memory 142 to provide agitation time and speed values for a variety of wash cycle types and profiles suited for particular garments or fabrics. Thus, agitation time and speed values may be customized across a wide variety of wash cycles and options that a user may select.

Once the agitation time duration value is set 180 and the agitation speed value is also set 188, controller 138 executes 190 the agitation phase of the wash cycle when appropriate according to a main control program. When the agitation phase is complete, algorithm 170 ends 192.

It is believed that those in the art of electronic controllers could construct and program controller 150 to implement the above-described methodology without further discussion.

A clothes washer control apparatus and method is therefore provided to substantially eliminate excessive wash cycle agitation. Consequently, laundry may be washed with less wear due to machine operations, and energy consumption in agitate portions is reduced. By controlling agitation portions of the wash cycle in response to the most pertinent input variables to the agitation process, both chemical and mechanical washing action are improved in an efficient and effective wash cycle.

While the invention has been described in terms of various specific embodiments, those skilled in the art will recognize that the invention can be practiced with modification within the spirit and scope of the claims.

What is claimed is:

1. An agitation phase control system for a washing machine, said control system comprising:

a drive system comprising an agitation element operable at a plurality of speeds during a wash cycle;

a first sensor positioned in the washing machine, and configured to detect a laundry soil level;

a load size detection device configured to detect a load size; and a controller operatively coupled to said drive system, said first sensor and said load size detection device, said controller actuating said agitation element to execute an optimized agitation phase during the wash cycle, wherein said controller sets an agitation time to optimize chemical cleansing action based on the detected laundry soil level and sets an agitation speed to optimize mechanical cleansing action based on the detected load size.

2. A control system in accordance with claim 1 wherein said controller comprises a microcomputer and a memory, said memory comprising control look up tables for adjusting said agitation time.

3. A control system in accordance with claim 1 wherein said controller comprises a microcomputer and a memory, said memory comprising control equations for adjusting said agitation time.

4. A control system in accordance with claim 1 wherein said controller is configured to receive feedback from said first sensor which detects at least one laundry load characteristic, and to vary operation of said agitation element in response to said at least one detected characteristic.

5. A control system in accordance with claim 1 wherein a second sensor is configured to detect the laundry load size, and said controller is configured to set the agitation speed based on the detected load size prior to executing the agitation phase.

* * * * *